US007219373B2

(12) United States Patent
McNamara

(10) Patent No.: US 7,219,373 B2
(45) Date of Patent: May 22, 2007

(54) REUSABLE CARRIER WITH EXPANDABLE, DISPOSABLE INSERT

(76) Inventor: Christopher McNamara, 458 Roberts Ave., Glenside, PA (US) 19038

( * ) Notice: Subject to any disclaimer, the term of this patent is extended or adjusted under 35 U.S.C. 154(b) by 498 days.

(21) Appl. No.: 10/940,839

(22) Filed: Sep. 14, 2004

(65) Prior Publication Data

US 2006/0053523 A1 Mar. 16, 2006

(51) Int. Cl.
*A41D 13/04* (2006.01)

(52) U.S. Cl. ..... 2/48; 2/51; 2/247

(58) Field of Classification Search ..... 2/48, 2/49.2, 51, 46, 47, 49.3–49.5, 49.1, 50, 52, 2/102, 247, 248, 253, 254, 249–251; 224/148.4, 224/148.5, 148.7, 669, 269, 230, 666, 904, 224/660, 663–667, 678, 679, 681, 605; 206/1.7, 206/1.8, 362.4; 220/495.01, 495.03, 495.02, 220/495.06, 495.08

See application file for complete search history.

(56) References Cited

U.S. PATENT DOCUMENTS

| | | | | | |
|---|---|---|---|---|---|
| 380,576 | A | * | 4/1888 | Ives | 2/51 |
| 453,490 | A | * | 6/1891 | Kropp | 2/49.2 |
| 2,717,109 | A | | 9/1955 | Walsh | |
| 2,785,409 | A | * | 3/1957 | Lackey | 2/51 |
| 2,945,614 | A | | 7/1960 | Wittmann, Sr. | |
| 3,283,971 | A | | 11/1966 | Jones | |
| 3,535,709 | A | | 10/1970 | Johannes | |
| 3,997,092 | A | | 12/1976 | Pogwizd | |
| 4,310,109 | A | * | 1/1982 | Coyle | 224/230 |
| 4,363,433 | A | | 12/1982 | Jaques | |
| 4,649,572 | A | * | 3/1987 | Roessler | 2/49.2 |
| 4,746,042 | A | * | 5/1988 | King | 224/148.2 |
| D296,268 | S | | 6/1988 | Bozarth | |
| 4,951,857 | A | * | 8/1990 | Carr | 224/230 |
| 4,972,982 | A | | 11/1990 | Harbour | |
| 5,016,791 | A | | 5/1991 | Burow | |
| 5,062,558 | A | * | 11/1991 | Stang | 2/49.2 |
| 5,489,051 | A | | 2/1996 | Robinson | |
| 5,566,391 | A | | 10/1996 | Williamson | |
| 5,943,696 | A | * | 8/1999 | Walker | 2/51 |
| 6,213,365 | B1 | | 4/2001 | Stocke et al. | |
| 6,719,178 | B1 | | 4/2004 | Taylor | |
| 6,769,136 | B1 | | 8/2004 | Martelly | |
| 2005/0045685 | A1 | * | 3/2005 | Sesto | 224/269 |

* cited by examiner

*Primary Examiner*—Amy B. Vanatta
(74) *Attorney, Agent, or Firm*—Michael Crilly, Esq.

(57) ABSTRACT

A reusable carrier with expandable, disposable insert is disclosed including an apron having at least one pocket and a disposable container therein. The disposable container includes a front wall and a back wall each having an outwardly disposed clip to secure the disposable container within a pocket of the apron, a pair of extendable side walls between and attached to both front and back walls, and an extendable bottom wall attached to front, back, and side walls to form a leakproof receptacle. In one alternate embodiment, a second disposable container is attached to the front wall of the disposable container. Alternate embodiments further comprise a stiffener attached to at least one of the side and bottom walls within the disposable container to prevent collapse of the container during use. In yet other alternate embodiments, a plurality of ribs are provided within the disposable container along both front and back walls to prevent splashing and spillage.

12 Claims, 7 Drawing Sheets

REUSABLE CARRIER WITH EXPANDABLE, DISPOSABLE INSERT

CROSS REFERENCE TO RELATED APPLICATIONS

None.

FEDERALLY SPONSORED RESEARCH OR DEVELOPMENT

None.

BACKGROUND OF THE INVENTION

1. Field of the Invention

The present invention generally relates to an apron having an expandable and disposable insert therein so as to provide one or more readily available reservoirs capable of holding paint, spackle, plaster and other viscous materials commonly used during repair and remodeling activities.

2. Background

Several design features are important to carrier devices for viscous materials, examples including paint, spackle, and plaster. The carrier device should hold a sufficient quantity of viscous material so as to minimize the number of refills required to complete a task. Several colors and/or material types should be readily accessible to the user. The carrier should sufficiently support the viscous material in a controlled fashion, minimize discomfort to the user, and provide an ergonomically elegant device in both form and function.

The related arts include a variety of devices to carry paint. Devices are separable into three distinct design categories. Carriers for paint-filled containers, including cans and buckets, are described by Martelly (U.S. Pat. No. 6,769,136 B1) Burow, (U.S. Pat. No. 5,015,791), Harbour (U.S. Pat. No. 4,972,982), Pogwizd (U.S. Pat. No. 3,997,092), Walsh (U.S. Pat. No. 2,717,109), and Bozarth (U.S. Pat. No. D296,268). Aprons having a paint tray are described by Williamson (U.S. Pat. No. 5,566,391), Johannes (U.S. Pat. No. 3,535,709), Jones (U.S. Pat. No. 3,283,971), and Wittmann (U.S. Pat. No. 2,945,614). Paint and/or brush carriers attachable to a belt or strap are described by Taylor (U.S. Pat. No. 6,719,178), Stocke et al. (U.S. Pat. No. 6,213,365), Robinson (U.S. Pat. No. 5,489,051), King (U.S. Pat. No. 4,746,042) and Jaques (U.S. Pat. No. 4,363,433).

The related arts teach carriers that are large and bulky in both storage and use. Furthermore, referenced inventions fail to prevent paint from contacting multi-use components thereby requiring cleanup after each such use.

What is required is a carrier that minimizes storage volume of the device prior to use, maximizes holding volume within the device during use, and is readily discardable after use so as to minimize cleanup.

SUMMARY OF THE INVENTION

An object of the present invention is to provide a reusable utility apron having a disposable insert therein whereby both apron and insert have a minimal storage profile prior to use.

Another object of the present invention is to provide a reusable utility apron having a disposable insert therein that is expandable prior to use so as to maximize the volume of material held therein.

Another object of the present invention is to provide a reusable utility apron having a disposable insert therein capable of holding a viscous material without leakage.

A further object of the present invention is to provide a reusable utility apron having a disposable insert therein that prevents paint, spackle, plaster or other viscous material from contacting the apron during use.

The present invention comprises an apron having at least one pocket and at least one disposable container therein. Each disposable container includes a front wall and a back wall each having an outwardly disposed clip to secure the disposable container within a pocket of the apron, a pair of extendable side walls between and attached to both front and back walls, and an extendable bottom wall attached to front, back, and side walls to form a leakproof receptacle.

It is likewise possible for the reusable carrier to comprise an apron having at least one pocket therein, a first disposable container, and a second disposable container. The first disposable container includes a first back wall having a first clip outwardly disposed to secure the container within the apron, a first front wall, a pair of extendable first side walls between and attached to both front and back walls, and an extendable first bottom wall attached to front, back, and side walls to form a leakproof receptacle. The second disposable container includes a second front wall, a second back wall attached to the front wall of the first container to form a second clip to secure first and second disposable containers to the apron, a pair of extendable second side walls between and attached to both front and back walls, and an extendable second bottom wall attached to second front, back, and side walls to form a leakproof receptacle.

Alternate embodiments of the reusable carrier further comprise a stiffener attached to at least one of the side and front walls within the disposable container. In yet other alternate embodiments, a plurality of ribs are provided within the disposable container along front, back, and/or side walls.

Two advantages are offered by the present invention. The discardable insert prevents contact between viscous material fill and reusable apron thereby minimizing cleanup. Apron and insert minimize storage volume required for the present invention.

BRIEF DESCRIPTION OF THE DRAWINGS

The invention will now be described in more detail, by way of example only, with reference to the accompanying drawings, in which.

REFERENCE NUMERALS

| | |
|---|---|
| 1 | Apron |
| 2 | Container |
| 3a–3c | Pocket |
| 4a–4b | Tie strap |
| 5 | Front wall |
| 6 | Back wall |
| 7 | Bottom wall |
| 8 | Front clip |
| 9 | Back clip |
| 10a–10b | Side wall |
| 11a–11b | Fold |
| 12 | Open end |
| 13 | Storage region |
| 14a–14f | Fold |
| 15 | Stiffener |
| 16 | Attachment |
| 17 | Fill |
| 18 | Brush |
| 19a–19b | Fold |
| 20 | Dual container system |
| 21 | First container |
| 22 | Second container |
| 23 | Back clip |
| 24 | Front clip |
| 25 | Back wall |
| 26 | Front wall |
| 27 | Front wall |
| 28 | Back wall |
| 31 | Rib |
| 32 | Pocket wall |
| 33 | Pocket wall |
| 34a–34d | Fold |
| 35a–35f | Fold |
| 36 | Fold |
| 37a–37c | Seam |
| 38 | Open side |
| 39a–39b | Open end |
| 40 | Left side |
| 41 | Right side |
| 42 | Bottom wall |
| 43 | Bottom wall |
| 44 | Pocket |

DESCRIPTION OF THE INVENTION

The present invention relates to a reusable carrier including an apron 1 and a container 2. FIGS. 1-8 describe the present invention and variations thereof While planar shaped walls are described, other wall shapes are possible, including, without limitation, curved and other non-linear shapes. Drawings are not to scale.

Figure 1:
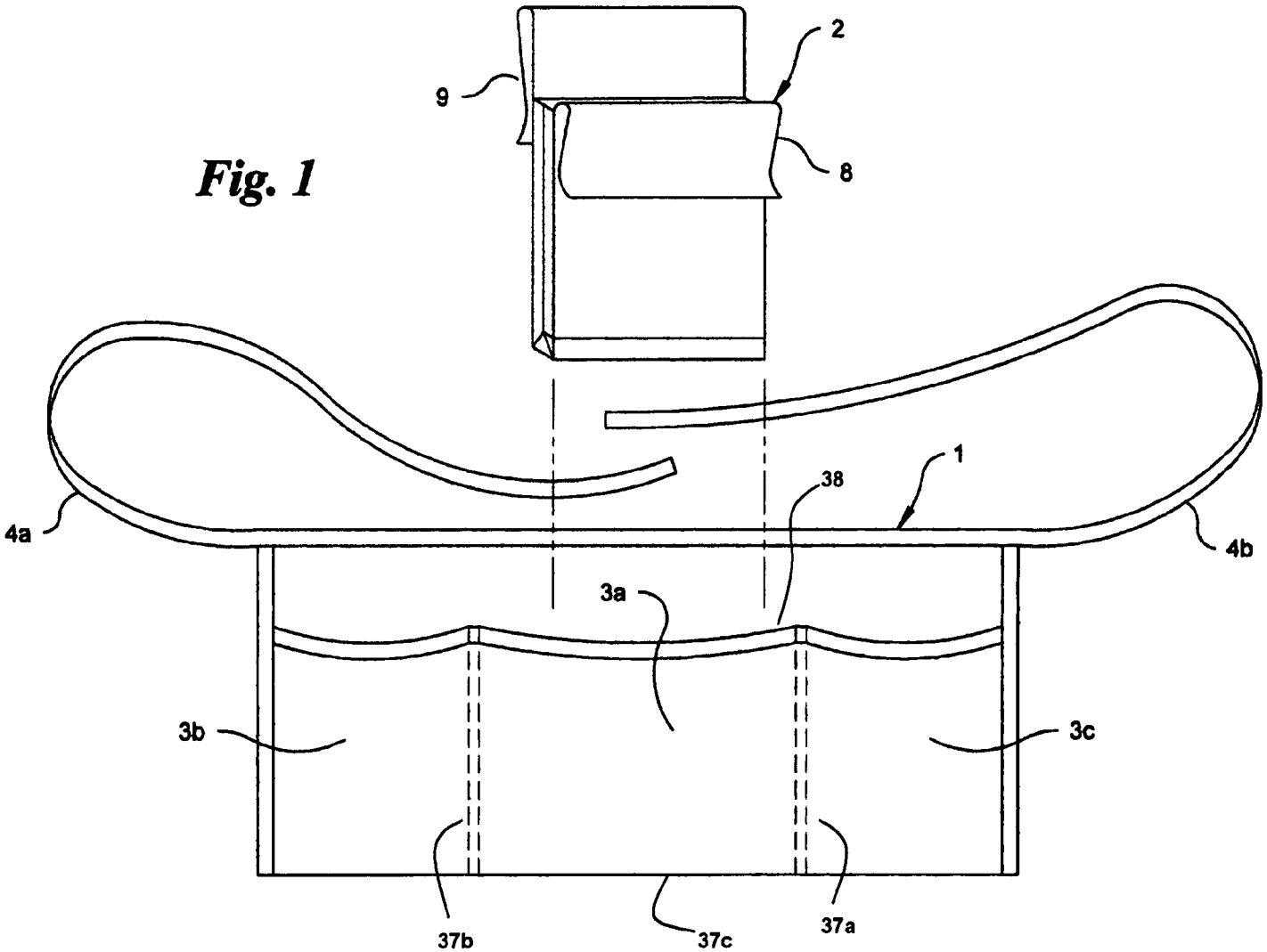
FIG. 1 is a perspective view of an exemplary embodiment of the present invention having an apron and a disposable container insert residing within one of several pockets along the apron.

Referring now to FIG. 1, an apron 1 is shown having three pockets 3*a*-3*c* and a single container 2 prior to its insertion into the center pocket 3*a*. While FIG. 1 shows an apron 1 having three pockets 3*a*-3*c*, the present invention may include one or more such structures. Likewise, it is possible for the present invention to have one or more containers 2 secured within one or more pockets 3*a*-3*c*.

Referring again to FIG. 1, the apron 1 is comprised of a flexible or semi-rigid material, non-limiting examples including cloth, canvas, and leather, having a tie strap 4*a*, 4*b* disposed at each end of the region comprising the pockets 3*a*-3*c*. Tie straps 4*a*, 4*b* enable the user to secure the apron 1 about the waist of the user. Pockets 3*a*-3*c* are a four-sided structure when expanded having several stitched or mechanically fastened seams 37*a*-37*c* with at least one open end 38. Pockets 3*a*, 3*b*, 3*c* may either match or conform to the shape of the container 2.

Figure 2A:
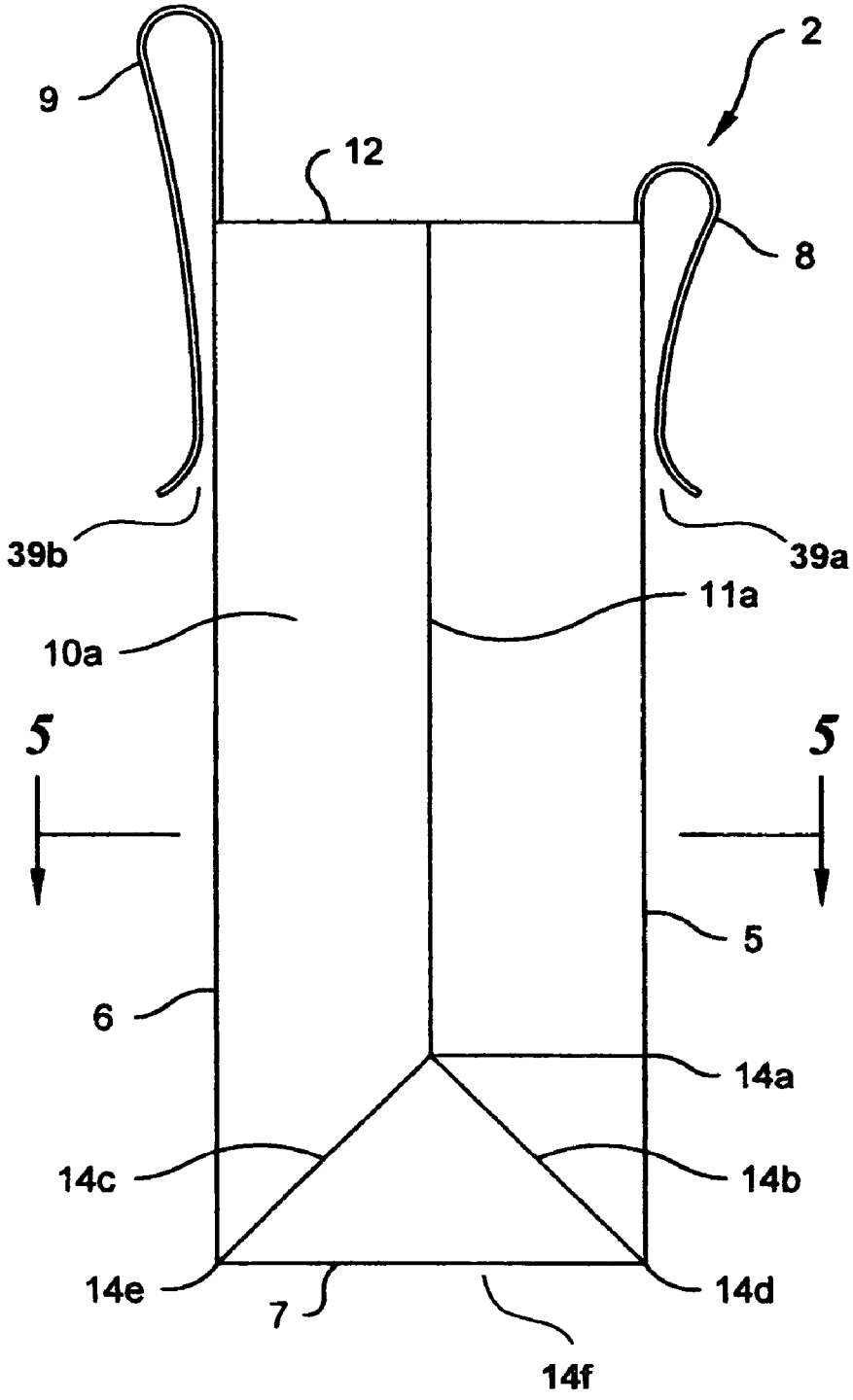
FIG. 2*a* is a side elevation view of one embodiment of the container having extendable side walls attached to and between a front wall and a back wall wherein both front and back walls each have a clip at one end.
Figure 3:
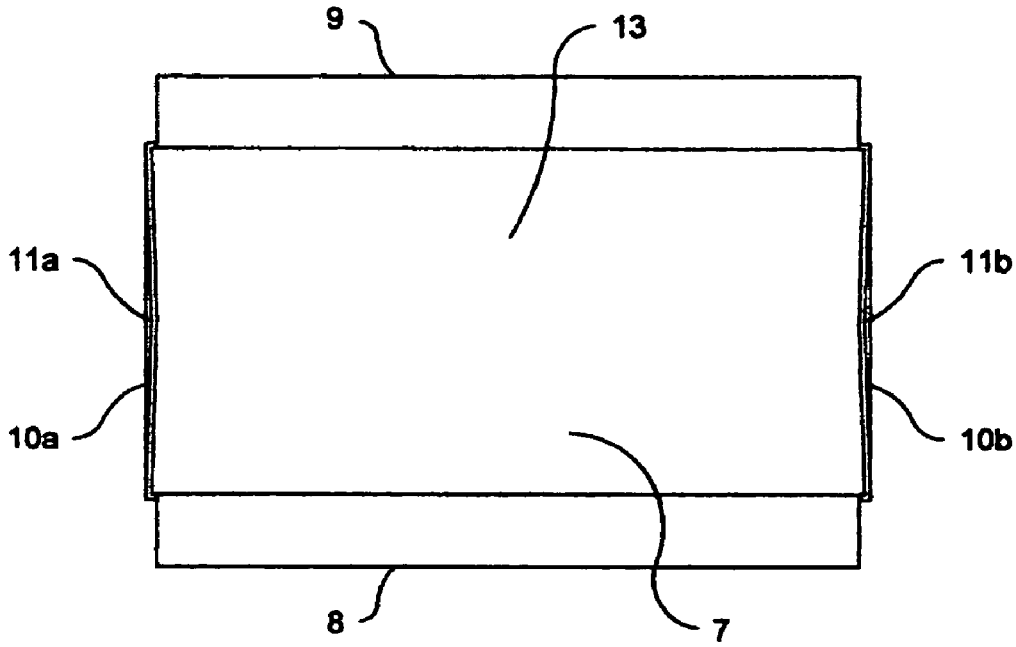
FIG. 3 is a top elevation view of the container in FIG. 2*a* having collapsible side walls extended, a front wall, a back wall, and a bottom wall thereby providing an open ended reservoir capable of holding a viscous material without leakage.

Referring now to FIGS. 2*a* and 3, a preferred embodiment of the present invention is shown having a pair of vertically disposed side walls 10*a*, 10*b* attached to a vertically disposed front wall 5 and a vertically disposed back wall 6. A horizontally disposed bottom wall 7 is attached to the side walls 10*a*, 10*b*, front wall 5, and back wall 6 at one end of each of the vertically disposed elements. An open end 12 is provided opposite of the bottom wall 7. Side walls 10*a*, 10*b*, front wall 5, back wall 6, and bottom wall 7 form a leak proof storage region 13 capable of holding a viscous material.

Figure 6:
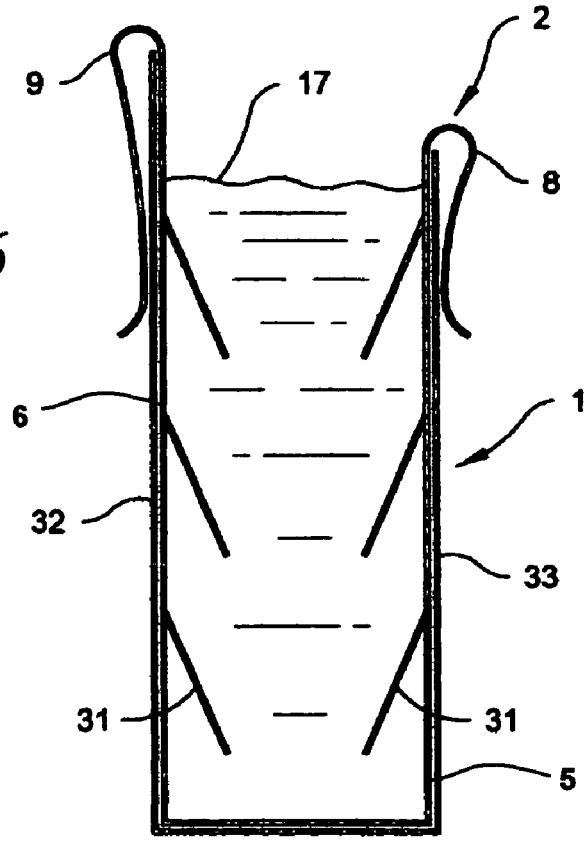
FIG. 6 is a section view of a container filled with a fluid within an exemplary pocket, wherein the container has optional ribs horizontally disposed along front and back walls to inhibit movement of fill.

A front clip 8 and back clip 9 are provided at the open end 12 of the container 2 adjacent to and disposed across the width of the front wall 5 and back wall 6, respectively. Front clip 8 and back clip 9 are generally c-shaped elements each having an open end 39*a*, 39*b*. As shown in FIG. 6, front clip 8 and back clip 9 are rigid yet expandable so as to contact the respective pocket wall 32 and 33 with a compressive yet releasable grip.

Front clip 8 and back clip 9 may include a variety of designs. For example, clips 8 and 9 may be comprised of commercially available binder clips or their functional equivalent. However, it is preferred to have the front clip 8 and back clip 9 integrally molded, bonded, or fastened to the container 2 and composed of the same material as the container 2.

As the container 2 is required to hold a viscous material or fluid for an extended period, it is preferred that contact between side walls 10*a*, 10*b*, front wall 5, back wall 6, and bottom wall 7 be leakproof and composed of a material resisting fluid migration. While a variety of flexible, fluid-proof materials are applicable to the present invention, several examples are plastics, including polyethylene and polypropylene, wax or plastic coated or impregnated paper and cardboard, and metals, including aluminum, brass, and steel. Container 2, front clip 8, and back clip 9 made be fabricated via molding, extrusion, and forming techniques understood for such materials.

Figure 4:
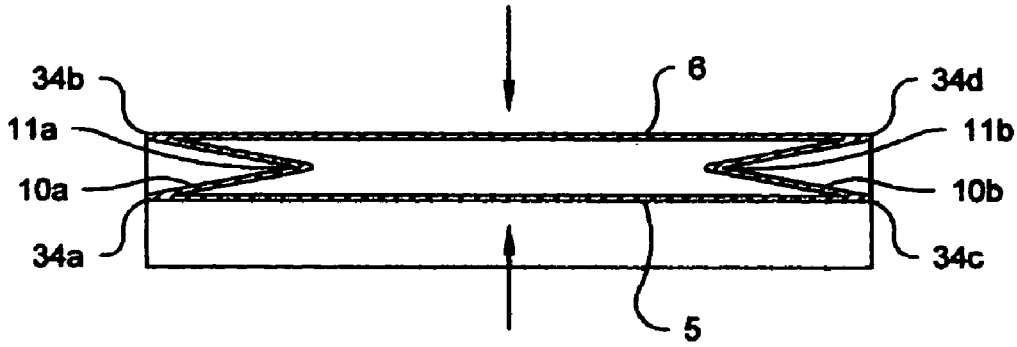
FIG. 4 is a section view of the container in FIG. 2*b* showing side walls collapsed inward to minimize storage profile.

Referring again to FIGS. 2*a*, 3, and 4, hinge-like folds 11*a*-11*b*, 14*a*-14*f* and 34*a*-34*d* are provided to allow for the compact storage of the container 2 prior to use and to facilitate extension of the walls comprising the container 2 during use. FIGS. 2*a* and 3 show a fold 11*a* and 11*b* vertically disposed along a portion of the central length of each side wall 10*a* and 10*b*, respectively. FIG. 2*a* also shows a fold 14*d* along the seam between front wall 5 and bottom wall 7, a fold 14*e* along the seam between back wall 6 and bottom wall 7, and a fold 14*f* between each side wall 10*a*, 10*b* and bottom wall 7. Two inclined folds 14*b* and 14*c* are provided along each side wall 10*a*, 10*b*, as shown in FIG. 2*a*. Likewise, FIG. 2*a* shows a fold 14*a* disposed across the width of the front wall 5 and traversing part of each side wall 10*a*, 10*b*, thereby contacting one end of folds 11*a* or 11*b*, 14*b*, and 14*c*. FIG. 4 shows folds 34*a* and 34*c* along seams between front wall 5 and side walls 10*a* and 10*b*, respectively, and folds 34*b* and 34*d* along seams between back wall 6 and side walls 10*a* and 10*b*, respectively.

Figure 2B:
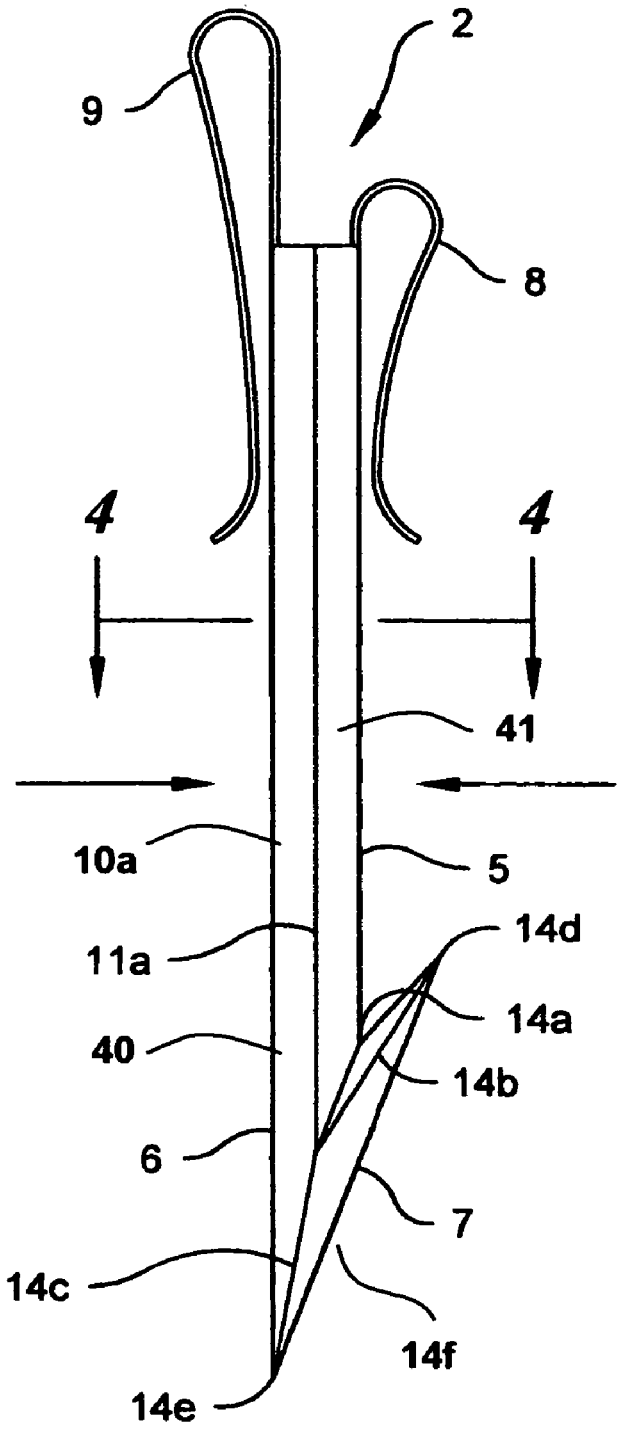
FIG. 2*b* is a side elevation view of the container in FIG. 2*a* with side and bottom walls collapsed to minimize storage profile.

Referring now to FIGS. 2*b* and 4, the container 2, as shown in FIGS. 2*a* and 3, respectively, is now shown with side walls 10*a* and 10*b* and bottom wall 7 collapsed to minimize the distance between front wall 5 and back wall 6 and to minimize the total volume occupied by the container 2. The container 2 is collapsed by applying pressure along front wall 5 and back wall 6 simultaneously and extended by pulling the front wall 5 and back wall 6 apart.

In FIG. 4, the otherwise planar side wall 10*a* forms a v-shaped structure having an oblique angle formed along the outer surface of the side wall 10*a* at fold 11*a*, an oblique angle between front wall 5 and side wall 10*a* at fold 34*a*, and an oblique angle between back wall 6 and side wall 10*a* at fold 34*b*. Likewise, the otherwise planar side wall 10*b* forms a v-shaped structure having an oblique angle formed along the outer surface of the side wall 10*b* at fold 11*b*, an oblique angle between front wall 5 and side wall 10*b* at fold 34*c*, and an oblique angle between back wall 6 and side wall 10*b* at fold 34*d*.

In FIG. 2*b*, the planar bottom wall 7 is collapsed and folded upward so that a portion of the bottom wall 7 partially covers the front wall 5. The left side 40 of the side wall 10*a* forms an oblique angle along fold 14*c* with the triangular region bounded by folds 14*b*, 14*c*, and 14*f* Resultantly, the back wall 6 and bottom wall 7 form an oblique angle along fold 14*e*. The triangular region bounded by the front wall 5 and folds 14*a* and 14*b* also forms an oblique angle along fold 14*b* with the triangular region bound by folds 14*b*, 14*c*, and 14*f*. Resultantly, the front wall 5 and bottom wall 7 form an oblique angle along fold 14*d*. The outer surface of the front wall 5 forms an oblique angle along fold 14*a*. The right side 41 of the side wall 10*a* forms an oblique angle along fold 14*a* with the triangular region bounded by the front wall 5 and folds 14*a* and 14*b*. Finally, the triangular region bounded by folds 14*b*, 14*c*, and 14*f* forms an oblique angle along fold 14*f* with the bottom wall 7. The described angles are likewise applicable to the second side wall 10*b*.

It is preferred to have the container 2 sufficiently rigid when side walls 10*a* and 10*b* and bottom wall 7 are extended so as to maintain the expanded shape shown in FIG. 2*a*. In some embodiments, the viscous material fill within the container 2 may assist in maintaining the expanded shape. However, a stiffening element may be required in some embodiments to insure the extended shape of the container 2.

Figure 5:
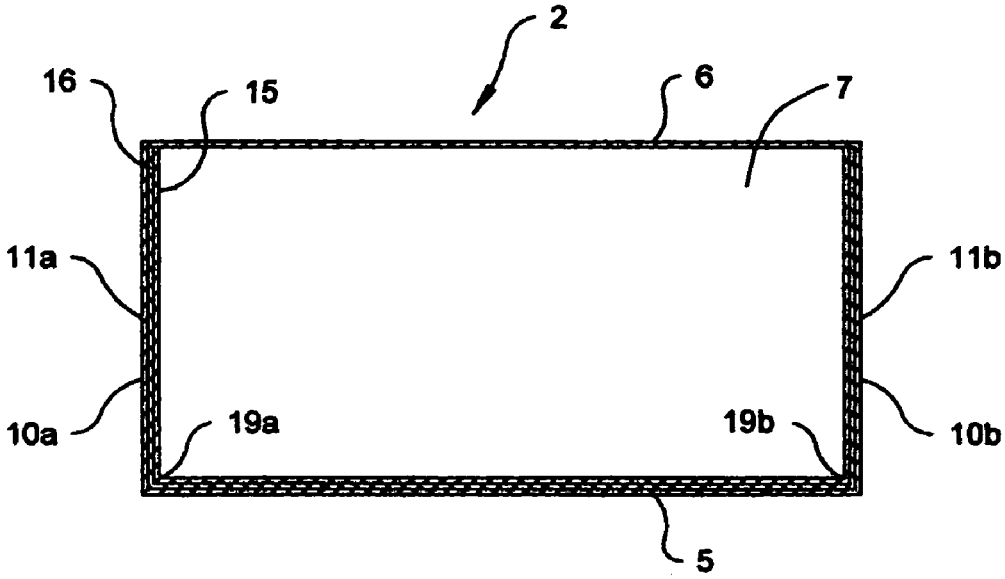
FIG. 5 is a section view of the container in FIG. 2*a* showing an optional stiffener attached to side and front walls to prohibit collapse thereof.

Referring now to FIG. 5, the collapsible side walls 10*a* and 10*b* and front wall 5 is shown having a u-shaped stiffener 15 attached to the interior of the container 2. While a variety of designs and shapes are possible, the exemplary stiffener 15 in FIG. 5 is comprised of a planar element having two folds 19*a*, 19*b* so as to conformally contact the interior of the container 2 and thereby prevent collapse of side walls 10*a*, 10*b* and bottom wall 7. It is preferred for the stiffener 15 to traverse folds 11*a* and 11*b* along side walls 10*a* and 10*b*, respectively.

While contact alone may be sufficient to stiffen and thereby prevent collapse, it may be required to secure the stiffener 15 to the container 2 via an attachment 16, as shown in FIG. 5. Exemplary attachments 16 include an adhesive bond or hook-and-loop device between stiffener 15 and side walls 10*a* and 10*b* and stiffener 15 and front wall 5.

In some embodiments, it may be preferred to limit motion of the fluid-like material within the container 2. Referring now to FIG. 6, the container 2 is shown having a plurality of horizontally disposed ribs 31 along both front wall 5 and back wall 6. However, ribs 31 may be placed along front wall 5, back wall 6, and/or side walls 10*a*, 10*b*. Exemplary ribs 31 include planar or nearly planar elements composed of the same or similar material comprising the container 2. Ribs 31 are adhesively bonded, mechanically fastened, or molded onto the container 2 within the region occupied by the fill 17. Ribs 31 may protrude into the fill 17 either in a horizontal orientation or at an angle, as shown in FIG. 6. In some embodiments, it may be desired to have ribs 31 project into the fill 17 so as to contact a tool as it extracts fill 17 from the container 2.

Figure 7:
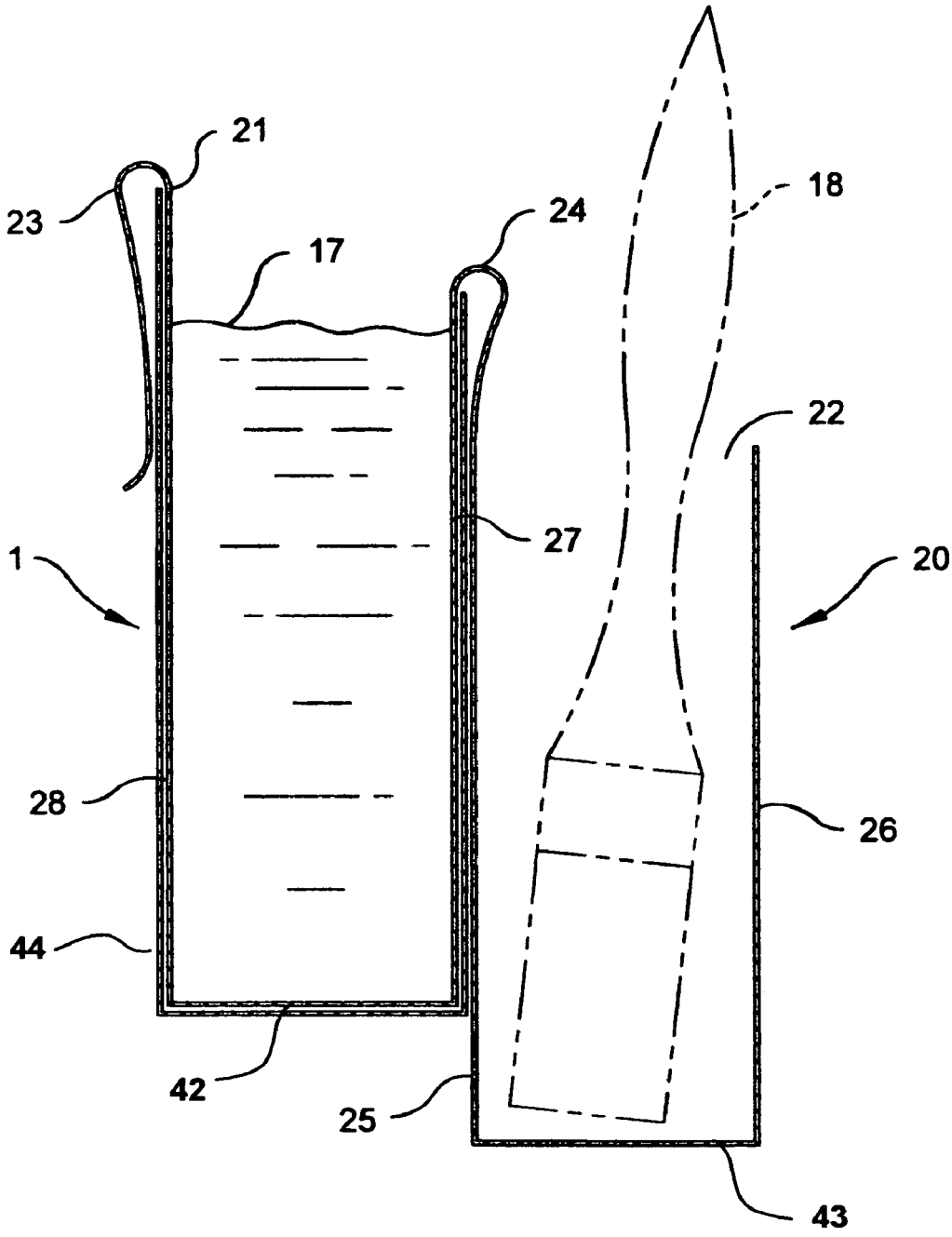
FIG. 7 is a section view of an alternate embodiment of the present invention having a first container filled with a viscous fluid within an exemplary pocket and a second container attached to the front wall of the first container and thereby disposed adjacent to the pocket.
Figure 8:
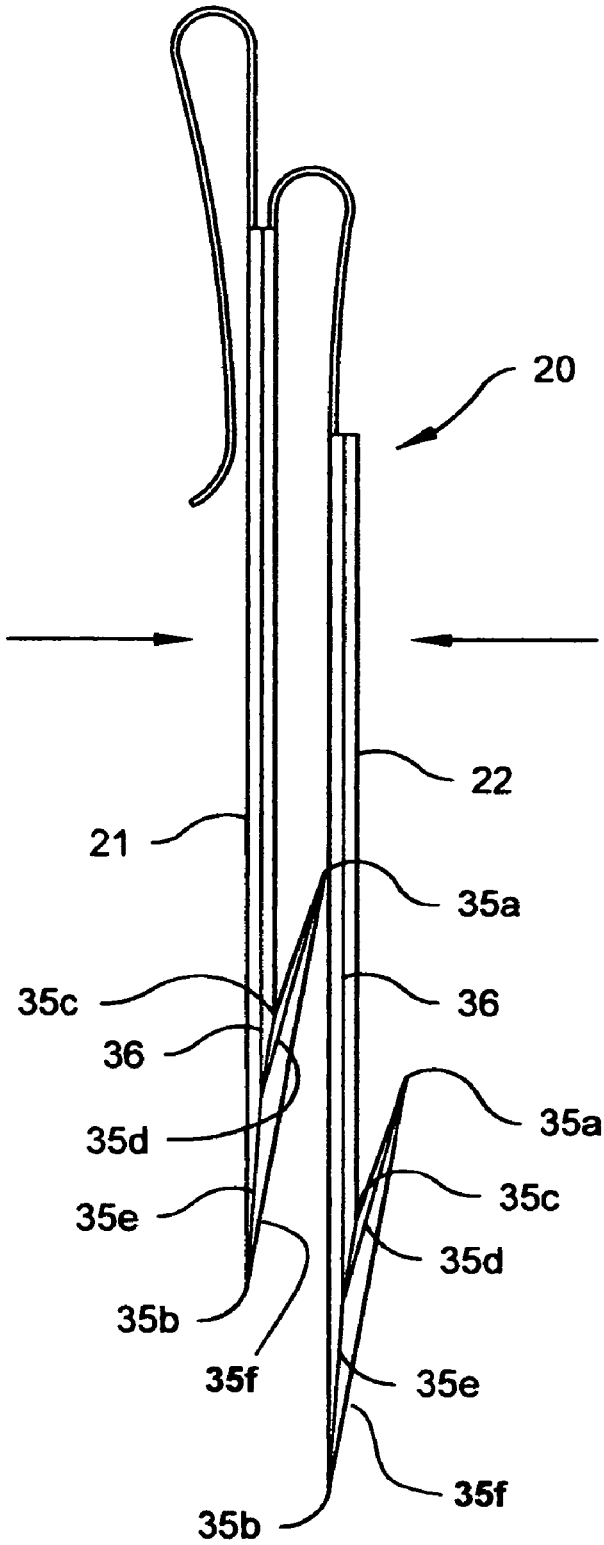
FIG. 8 is a side elevation view of the alternate embodiment in FIG. 7 showing both first and second containers after collapse of side and bottom walls to minimize storage profile.

Referring now to FIGS. 7 and 8, an alternate embodiment of the present invention is shown comprising a first container 21 and a second container 22. While a variety of uses are possible for the dual container system 20 shown in FIG. 7, one such use includes holding a liquid or viscous fill 17 within the first container 21 and a brush 18 or other tool in the second container 22.

Referring to FIG. 7, the first container 21 has a front wall 27, back wall 28, bottom wall 42 and side walls (not shown). The first container 21 is supported within a pocket 44 along the apron 1. A back clip 23 is provided at the upper end of the back wall 28 so as to secure the dual container system 20 to the apron 1. The back clip 23 may be a separate element or integrally molded, bonded, or fastened to the first container 21, as described above. The second container 22 also includes a front wall 26, back wall 25, bottom wall 43 and side walls (not shown). The back wall 25 of the second container 22 and front wall 27 of the first container 21 are attached or otherwise secured via a front clip 24. The front clip 24 may be molded, adhesively attached, or mechanically fastened to both first container 21 and second container 22. The front clip 24 mechanically compresses the back wall 25 against the front wall 27 so as to form an elongated structure enabling the dual container system 20 to grip the pocket 44, as shown in FIG. 7.

The dual container system 20 is likewise collapsible and extendible as described above for the embodiment shown in FIGS. 1-5. Referring to FIG. 8, the dual container system 20 is shown with walls collapsed to minimize the volume occupied thereby. As described for FIGS. 1-5, first container 21 and second container 22 each have a fold 36 disposed along each side wall comprising the two structures. Likewise, folds 35*a*-35*f* are provided at the lowermost end of the both first container 21 and second container 22, as well as along seams between wall elements.

Stiffeners 15, attachments 16, and ribs 31 described above are likewise applicable to both first container 21 and second container 22.

The description above indicates that a great degree of flexibility is offered in terms of the present invention. Although the invention has been described in considerable detail with reference to certain preferred versions thereof, other versions are possible. Therefore, the spirit and scope of the appended claims should not be limited to the description of the preferred versions contained herein.

What is claimed is:

1. A reusable carrier comprising:

(a) an apron having at least one pocket therein; and (b) a disposable container comprising:

(i) a front wall;

(ii) a back wall, said front wall and said back wall each having an outwardly disposed clip to secure said disposable container within said pocket;

(iii) a pair of extendable side walls between and attached to said front wall and said back wall; and (iv) an extendable bottom wall attached to said front wall, said back wall, and said side walls to form a leakproof receptacle.

2. The reusable carrier of claim 1, further comprising:

(c) a stiffener within and contacting said disposable container.

3. The reusable carrier of claim 2, wherein said stiffener is attached to said disposable container via an adhesive.

4. The reusable carrier of claim 2, wherein said stiffener is attached to said disposable container via a hook-and-loop device.

5. The reusable carrier of claim 2, further comprising:

(d) a plurality of ribs within said disposable container and horizontally disposed therein.

6. The reusable carrier of claim 1, further comprising:

(c) a plurality of ribs within said disposable container and horizontally disposed therein.

7. A reusable carrier comprising:

(a) an apron having at least one pocket therein;

(b) a first disposable container comprising:

(i) a first back wall having a first clip outwardly disposed to secure said first disposable container within said pocket;

(ii) a first front wall;

(iii) a pair of extendable first side walls between and attached to said first front wall and said first back wall; and (iv) an extendable first bottom wall attached to said first front wall, said first back wall, and said first side walls to form a leakproof first receptacle; and (c) a second disposable container comprising:

(i) a second front wall;

(ii) a second back wall, said first front wall and said second back wall forming a second clip to secure said first disposable container and said second disposable container to said pocket;

(iii) a pair of extendable second side walls between and attached to said second front wall and said second back wall; and (iv) an extendable second bottom wall attached to said second front wall, said second back wall, and said second side walls to form a leakproof second receptacle.

8. The reusable carrier of claim 7, further comprising:

(d) a stiffener within and contacting each said first disposable container and said second disposable container.

9. The reusable carrier of claim 8, wherein each said stiffener is attached to said first disposable container and said second disposable container via an adhesive.

10. The reusable carrier of claim 8, wherein each said stiffener is attached to said first disposable container and said second disposable container via a hook-and-loop device.

11. The reusable carrier of claim 8, further comprising:

(e) a plurality of ribs within said first disposable container and said second disposable container and horizontally disposed therein.

12. The reusable carrier of claim 7, further comprising:

(d) a plurality of ribs within said first disposable container and said second disposable container and horizontally disposed therein.

* * * * *